US007178691B1

(12) United States Patent
Rux

(10) Patent No.: US 7,178,691 B1
(45) Date of Patent: Feb. 20, 2007

(54) TOILET PAPER STORAGE AND DISPENSER CONTAINER

(76) Inventor: Paul R. Rux, 5125 Mountain View Dr., Las Vegas, NV (US) 89146-1423

( * ) Notice: Subject to any disclaimer, the term of this patent is extended or adjusted under 35 U.S.C. 154(b) by 435 days.

(21) Appl. No.: 10/712,580

(22) Filed: Nov. 12, 2003

Related U.S. Application Data

(60) Provisional application No. 60/428,870, filed on Nov. 23, 2002.

(51) Int. Cl.
*B65H 3/00* (2006.01)

(52) U.S. Cl. ..... 221/191; 221/251; 221/255; 221/263

(58) Field of Classification Search ..... 221/33, 221/47, 48, 63, 312 R, 191, 194, 196, 246, 221/251, 255, 256, 263, 289; 206/233; 312/45, 312/72

See application file for complete search history.

(56) References Cited

U.S. PATENT DOCUMENTS 2,592,346 A * 4/1952 Scogin ..... 242/558
2,881,941 A * 4/1959 Tosch ..... 220/477
3,316,040 A * 4/1967 McGann ..... 312/45
3,865,295 A 2/1975 Okamura
4,363,454 A 12/1982 Mohar
4,463,912 A 8/1984 Grunerud
4,662,577 A 5/1987 Lewis
4,684,075 A 8/1987 Francis
5,377,866 A * 1/1995 Watters, II ..... 221/194
5,765,719 A * 6/1998 Upham et al. ..... 221/196
6,161,794 A * 12/2000 Cravatt ..... 242/560.3
6,619,504 B2 * 9/2003 Ozimec ..... 221/115

* cited by examiner

*Primary Examiner*—David H. Bollinger

(57) ABSTRACT

A toilet paper storage and dispenser container in which to store and manually dispense rolls of toilet paper. The container comprises a convex container front in the form of a slidable face plate and a removable lid, an access door in which to extract a roll and a finger access slot in which a finger is inserted to remove a spare roll of toilet paper, a viewing aperture to visually see the number of spare rolls available. The holding container fits snugly into a bathroom corner crevice where two walls meet or could come in a form that can be mounted flush on a wall. The container comprises a strap and track mechanism that holds upper rolls in the container from falling down while the door is opened.

10 Claims, 7 Drawing Sheets

TOILET PAPER STORAGE AND DISPENSER CONTAINER

CROSS REFERENCE TO RELATED APPLICATIONS

I hereby claim benefit under Title 35, United States Code, Section 119(e) of U.S. provisional patent application 60/428,870 filed Nov. 23, 2002 is currently pending. The Ser. No. 60/428,870 is hereby incorporated by reference into this application.

BACKGROUND OF THE INVENTION

1. Field of the Invention

The present invention relates generally to spare toilet paper roll storage and dispenser containers and more specifically it relates to a toilet paper storage and dispenser container providing a decorative container to hold spare rolls of toilet paper dispensed in a unique way preventing extra rolls from dropping directly onto lower rolls thereby causing them to fall out when the container access door is opened.

2. Description of the Prior Art

It can be appreciated that spare toilet paper roll storage and dispenser containers have been in use for years.

Examples of these containers are outlined below.

EP0413407 relates to a toilet tissue dispenser (Spindle Release) in which a two-roll toilet paper dispenser has a vertical spindle with stop means part way up the spindle. The stop means divides the spindle into a lower portion on which a first toilet paper roll is mounted in an operative position and an upper portion on which a second toilet paper roll is mounted in a storage position. Actuating means are provided for operating the stop means to permit a roll resting thereon in the storage position to drop down the spindle to the operative position.

U.S. Pat. No. 4,684,075 relates to a toilet paper dispenser provided within a housing adapted to be wall mounted. The dispenser comprises a vertically disposed open ended tube mounted inside the housing which is adapted to receive a plurality of rolls of paper. The bottom end of the tube is laterally spaced from the floor of the housing by a distance greater than the height of a roll of paper. The first lever is mounted and biased to a position directly underneath the bottom of the housing to prevent rolls of paper in storage from falling out of the tube, but is pivotal about a vertical axis to clear the bottom of the tube and thus allow a new roll of paper to drop down. A second lever is spaced a distance up the tube to pass into a slot defined in the tube at a level intersecting the second roll of paper from the bottom of the tube. The second lever is biased to clear the tube but is pivotal about a vertical axis to enter the aperture. The first and second levers are connected so that pivoting of the first lever to clear the tube pivots the second lever into the aperture bearing against the second roll of paper in storage. By the co-operating action of the two levers, only one roll of paper drops from storage at a single time.

U.S. Pat. No. 4,662,577 relates to a toilet tissue dispenser having an automatic locking device for preventing theft of toilet tissue rolls, in which the dispenser is of substantial construction capable of having full rolls of toilet tissue inserted from the top and contained securely therein by a lid cover locked in place, and when a new tissue roll is needed for the tissue dispensing portion of the dispenser, a pivot mechanism is swung by a handle through a 90 degree arc for positioning a spindle in axial alignment with a lower one of several tissue rolls which is dropped in place thereon and the received dispensing tissue roll is pivoted along with the pivot mechanism back to its initial horizontal position, so that the tissues are easily dispensed there from. A protector shield is provided for an ejector mechanism useful in dislodging an empty core of the tissue roll transverse of the toilet tissue dispenser. When the pivot mechanism and a full roll of tissue is in horizontal position, a locking plunger or pin becomes aligned with and enters a hole in the back of the dispenser for locking the pivot mechanism so it will remain locked until a spring biased ejector plate has ejected the core of the depleted roll of tissue with movement of the ejector plate retracting the plunger to enable movement of the pivot mechanism to a position to receive a full roll of tissue.

U.S. Pat. No. 4,463,912 relates to a multi-roll dispenser for toilet tissue and other similar roll material having a hollow core. The dispenser has a storage container which allows a plurality of rolls to be stored in an end-to-end stack arrangement. The lowest roll can be dispensed by a user through a side opening in the storage container. When the lowest roll is completely used, the user can discharge the roll core by pulling a slide plate outwardly to align an aperture in the slide plate with the used core. The core also drops through a core opening in a pivot plate immediately below the slide plate. The next roll of tissue drops to the slide plate and is supported thereon because it is larger than the core aperture. The dispenser is filled by releasing a lock means and rotating the storage container into a horizontal position. The horizontal position allows a catch means to be released so that the assembly normally supporting the rolls can be swung out of position thereby allowing new rolls of tissue paper to be inserted through the bottom end of the storage container.

A core rod extends from the top end of the storage container in a cantilevered arrangement to align the tissue rolls and to keep the lowest roll from being stolen from the dispenser.

EP0108739 relates to a device for the distribution of materials wound on a support such as for the distribution of paper or other materials in sheet form which have been wound on a hollow cylindrical central support and, in particular, a toilet-paper roll dispenser, the device comprising at least one back-up roll which can be automatically dropped into a use position. The device is provided with a locking means which prevents the roll being used from falling before it is virtually used up.

U.S. Pat. No. 4,363,454 relates to a tissue roll storage and dispenser apparatus comprising an open-bottomed cabinet having a storage space, a roll support and dispenser device pivotably mounted in the cabinet below the storage space and roll support plate and a cylindrical roll holder below the support plate, and an operating handle accessible from the exterior of the cabinet for pivotably moving the device 90 degrees between a roll-dispensing position and a roll-receiving position. In the roll-dispensing position, rolls of tissue are stacked one on top of another in the storage space with their axes in vertical alignment on the roll support plate. The device is then swung upwardly to roll-receiving position by means of the operating handle, causing the roll support plate to tilt and lift the stack of rolls upward in the storage space until the free end of the cylindrical roll holder engages the core of the lowermost roll in the stack, whereupon that roll drops onto the roll holder. The device is then swung to roll-dispensing position by means of the operating handle wherein the roll on the roll holder is horizontally disposed and accessible through the open bottom of the cabinet and the remaining rolls slide downward to rest upon the support plate. A latch is provided for preventing the device from being tilted upward to receive a new roll until the depleted roll core is axially removed through an access hole in the side of the cabinet.

NL7409712 relates to a toilet paper dispensing machine having a cover releasing an empty roll and allowing a fresh one to drop into place. The housing accommodates a roll accessible via an opening in the front and from which the paper is unrolled, this being carried in supports movable in relation to each other in the axial direction, while a number of reserve rolls are stacked above it. The front opening can be shut by swinging down a cover on a horizontal axis, and this causes the roll supports to move apart, while opening it moves them together again, and at the same time holds the spare rolls up. Thus operation of the cover releases an empty roll, which falls into a hopper underneath, and at the same time allows a fresh one to drop into a position in which the supports engage with it as soon as the cover is swung up again.

U.S. Pat. No. 3,865,295 relates to a toilet paper roll holding device comprising a housing receiving a plurality of toilet paper rolls one upon another with their axes lying in parallel to each other and including a pair of spaced side walls provided with paper roll core guide grooves; a rockable paper roll receiving and core discharge member pivoted to said side walls and including a pair of spaced arms extending uprightly; a pair of arcuate tracks formed on said side walls on which said arms are guided as said rockable member is pivoted and operation means for said rockable member provided on one of said arms and one of said side walls adjacent to said one arm.

FR2659216 relates to a device for storing and dispensing rolls of toilet paper. The device is designed as an automatic dispenser, it is fixed to the wall of WC's within hand's reach. It can contain 6 to 8 rolls of toilet paper stacked up in a tube, the last roll being offered up into an opening made on the side of the lower part of the cylinder. The rolls drop down in the tube as they are used. Perforations made over the entire height of the cylinder make it possible to view the number of rolls available in the dispenser.

The main problem with conventional toilet paper roll dispensers is the drop mechanism can fail requiring a user's hand be forced up into the spare roll area to make a toilet paper roll drop down. The present toilet paper storage and dispenser container contains a spare storage container but not a manual or automatic toilet paper spring loaded dispenser. When the container's door is manually opened to remove a single roll of toilet paper, other rolls stored in the container are held in place while the door is open. The next roll of toilet paper is extracted from the door and manually placed on a spring mounted toilet paper roll dispenser.

Another problem with spare toilet paper roll containers is they do not look like a piece of quality bathroom cabinetry but are usually contained in a lace holder or combined spare toilet paper container and spring loaded dispensing unit.

While these devices may be suitable for the particular purpose to which they address, they are not suitable to provide both a decorative storage cylinder for holding spare toilet paper rolls and they do not have the unique mechanism stopping other rolls from dropping directly onto the lower rolls or out of a spare roll cabinet all at one time as in the toilet paper storage and dispenser container of this invention nor has any of the available prior art been designed to have the look and feel of a custom piece of bathroom furniture or bathroom cabinetry as outlined in this invention.

In these respects, the toilet paper storage and dispenser container according to the present invention substantially departs from the conventional concepts and designs of the available prior art, and in so doing provides a device primarily developed to provide a decorative spare toilet paper container for storing and manually extracting toilet paper rolls enabling each roll be dispensed in a unique way so that all stored rolls do not fall out of the access door at the same time nor requiring they be forcibly ejected when they fail to drop down.

SUMMARY OF THE INVENTION

In view of the foregoing disadvantages inherent in the known types of spare toilet paper containers and dispensers present in the prior art, the present invention provides a spare toilet paper storage and a dispenser container wherein the cylinder is refillable as well as decorative, from which toilet paper rolls are dispensed in a unique way to prevent previous rolls from dropping directly onto lower rolls causing them to all fall out when a front access door is opened or when one rolls fails to automatically drop down and must be manually forced out in order to be placed on a spring loaded or other type of toilet paper roll holder.

The general purpose of the present invention, which will be described subsequently in greater detail, is to provide a new toilet paper storage and dispenser container for spare rolls of toilet paper that has many of the advantages of the available prior art mentioned heretofore as well as novel features that result in a new toilet paper storage and dispenser system which is not anticipated, rendered obvious, suggested, or even implied by any of the available prior art either alone or in any combination thereof.

To attain this, the present invention generally comprises a tube-like container designed to fit into a bathroom corner crevice where two walls meet. The container is designed to hold spare rolls of toilet paper. When the lower roll is removed it is placed on a separate spring-loaded roll dispenser usually available in most bathrooms. The container has a lid which when it is opened enables stocking of several rolls of toilet paper within the tube-like container. The container has a viewing aperture to visually see the numbers of rolls of toilet paper in the container as well as a front exit door and finger access slot on the door. A unique strap and track mechanism allows upper rolls of paper that are not being dispensed to be held in place while the door is open.

Thus has been outlined, rather broadly, the more important features of the invention in order that the detailed description thereof may be better understood, and in order the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components and sub-components as set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a spare toilet paper storage container and a dispenser system container that will overcome the shortcomings of the available prior art devices.

An object of the present invention is to provide extra toilet paper storage and a dispenser system providing a decorative and fillable storage container for holding spare rolls of toilet paper.

Another object of the present invention is to provide a convenient storage container for spare rolls of toilet paper having a dispensing system.

Another object of the present invention is to provide a decorative piece of quality bathroom furniture or cabinetry not presently available in which a convenient finger access slot is provided for ease of roll extraction from an opened container door and a handy viewing aperture.

Another object of the invention is to provide a slot allowing the lower roll to be extracted when the door is opened through the use of a finger access slot on the lower portion of the door.

Another object of the invention is to provide a viewing aperture window molded into the front of the container to provide a visual inventory assessment of spare rolls of toilet paper.

Another object of the invention is to provide a container lid that allows easy filling of the container.

Another object of this invention is to provide a mechanism that holds upper rolls in place while the door of the container is open to stop any of the rolls dropping.

Other objects and advantages of the present invention will become obvious to the reader and it is intended that these objects and advantages are within the scope of the present invention.

To the accomplishment of the above and related objects, this invention may be embodied in the forms illustrated in the accompanying drawings, attention being called to the fact, however, that the drawings are illustrative only, and that changes made be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
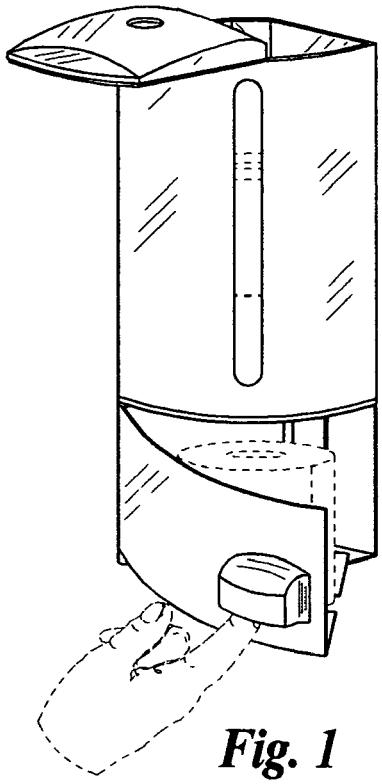
FIG. 1 shows an overall view of the container of the invention with its door opened and lid askew.

Turning now descriptively to the drawings, in which similar reference characters denote similar elements throughout the several views, the attached figures illustrate a toilet paper storage and dispenser container, which comprises:

The present invention generally comprises a toilet paper storage container as shown in overview in FIG. 1 containing spare rolls of toilet paper. In this figure the lid is shown askew and the access door open.

Figure 2:
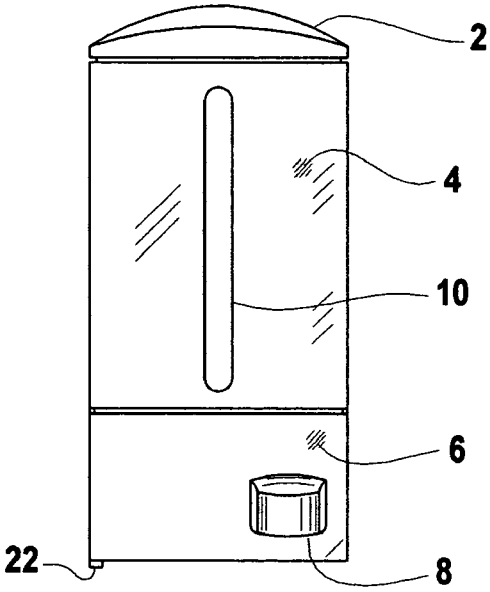
FIG. 2 shows a front view of the container showing the finger access slot and the toilet roll supply aperture (vertical viewing slot)

FIG. 2 shows a front view of the invention. The container comprises a convex container front in the form of a slidable face plate 4 and a removable lid 2, an access door 6 in which to extract a toilet roll and a finger access slot 8 in which a finger is inserted to remove a spare roll of toilet paper and a viewing aperture 10 to visually see the number of spare rolls available. The holding container fits snugly into a bathroom corner crevice where two walls meet or could come in a form that can be mounted flush on a wall. A hinge pin is shown at 22 that is part of the door mechanism allowing it to pivot open.

Figure 3:
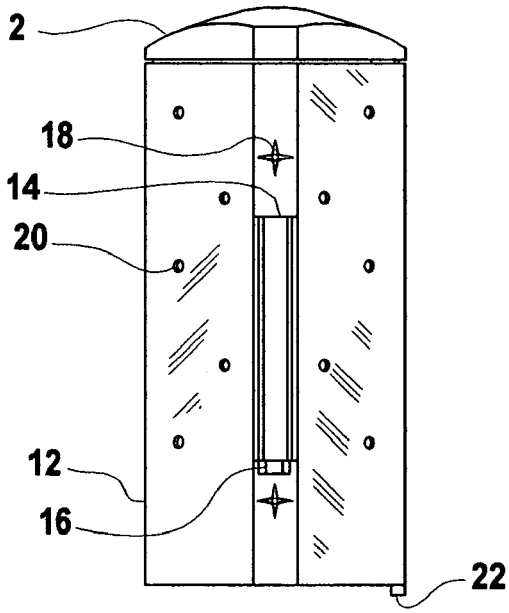
FIG. 3 shows a back view of the container showing the strap holding track, security screw mounting hole and individual wall mounting holes plus the backside of the lid.

FIG. 3 shows a rear view of the invention. This view shows a reinforced mounting hole 18 for attachment to a surface and mounting holes 20 also for mounting the container 12 onto a surface. It is foreseen that the container 12 will be mounted in a corner crevice where two walls meet as stated above but a "flat" version is also an option and not ruled out. This figure shows a strap holding track 14 and a toilet roll supporting strap 16. When the door 6 is opened, the supporting strap 16 slides down from the inside track 14 to a maximum extension point. When the door is closed, the strap 16 slides back upwards inside the track 14 in the back of the container 12. This strap can be made of any suitable material that is considered strong enough and flexible enough for its purpose such as thick plastics. The strap 16 slides down and outwards when the door 6 is opened and back up into the track 14 when the door is closed.

When the door is closed and a lower roll has been dispensed, gravity will make the next roll to be used to drop down to make it available for use. When the door 6 is open, as stated above, the strap 16 is in an extended position at the upper portion of where the roll to be dispensed was and below the next roll to be dispensed and therefore holds this roll, the one to be dispensed next, secure in it's position. The rear of the lid 2 is shown in this figure.

Figure 4:
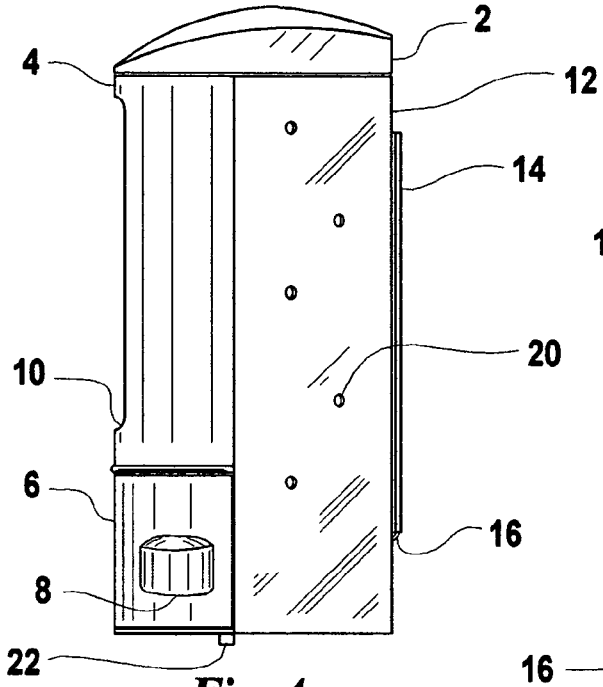
FIG. 4 shows a left side view of the container.
Figure 5:
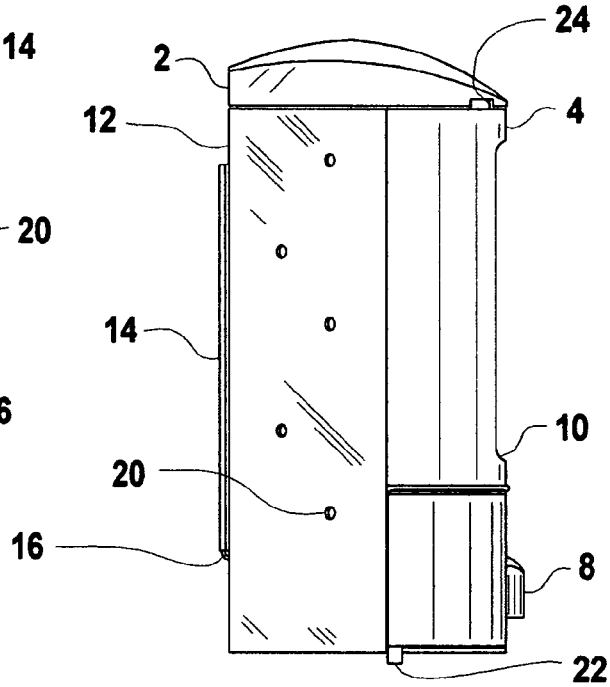
FIG. 5 shows a right view of the container.

FIG. 4 shows a left-hand view of the container 12 and FIG. 5 shows a right hand view of the container 12. The lid is shown referenced at numeral 2. The face plate 4 is removable from the container 12 and slides off. A viewing aperture is provided at 10 which allows a user to view how many spare toilet rolls are present in the container. The door 6 has a finger access slot 8 in which a user inserts his/her finger and allows the door 6 to be opened. A hinge pin is shown at 22 on which the door pivots. Mounting holes are referenced at 20 and the strap track described above is shown at 14 and the strap 16.

Figure 6:
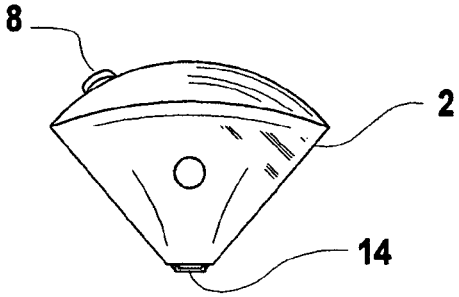
FIG. 6 shows a top view looking down on the container.
Figure 7:
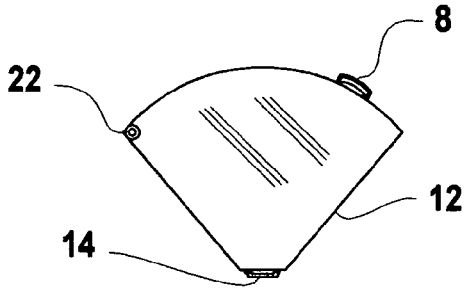
FIG. 7 shows a bottom view looking up of the container.

FIG. 6 shows a top view of the container and FIG. 7 shows a view from the bottom of the container. Taking the top first as can be seen is the strap track 14, the lid 2 and the finger access slot 8. Looking from the bottom view is the finger access slot 8, the base of the container 12, the strap track 14 and the hinge pin 22.

Figure 8:
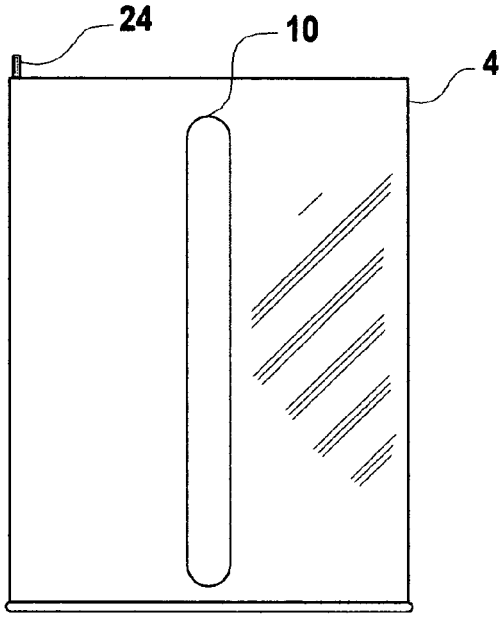
FIG. 8 shows a front view of the removable face plate and aperture window.

FIG. 8 shows a front view of the removable faceplate 4 and aperture window 10. The face plate has a hinge pin 24.

Figure 9:
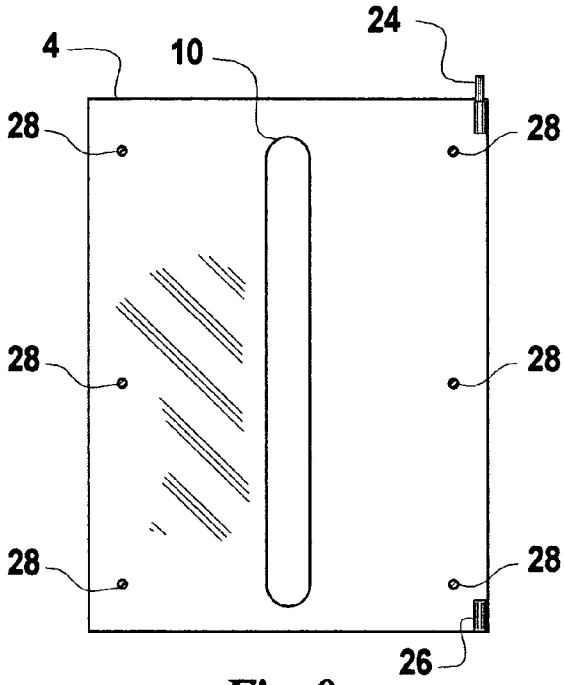
FIG. 9 shows an inside view of the back of the container.
Figure 10:
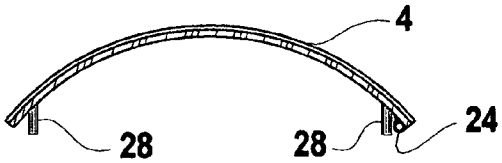
FIG. 10 shows an end view of the front part of the container.

FIG. 9 shows an inside view of the back of the removable faceplate 4. Numerals 28 show assembly pins which insert into pin compression holders 30 (not shown in this figure). The rear of the aperture window is shown at 10 and hinge pin 24 and hinge pin socket 26 are used for assembly of the device. FIG. 10 shows a top end view of the face plate 4 showing clearly the hinge pin 24 and the assembly pins 28.

Figure 11:
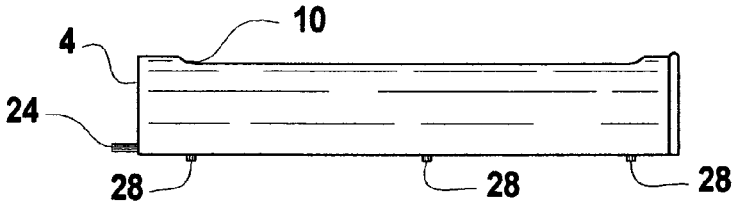
FIG. 11 shows a side view of the container showing the window aperture used to view the toilet paper roll supply.

FIG. 11 shows a side view of the plate 4 once again showing the aperture window 10, the hinge pin 24 and the assembly pins 28.

Figure 12:
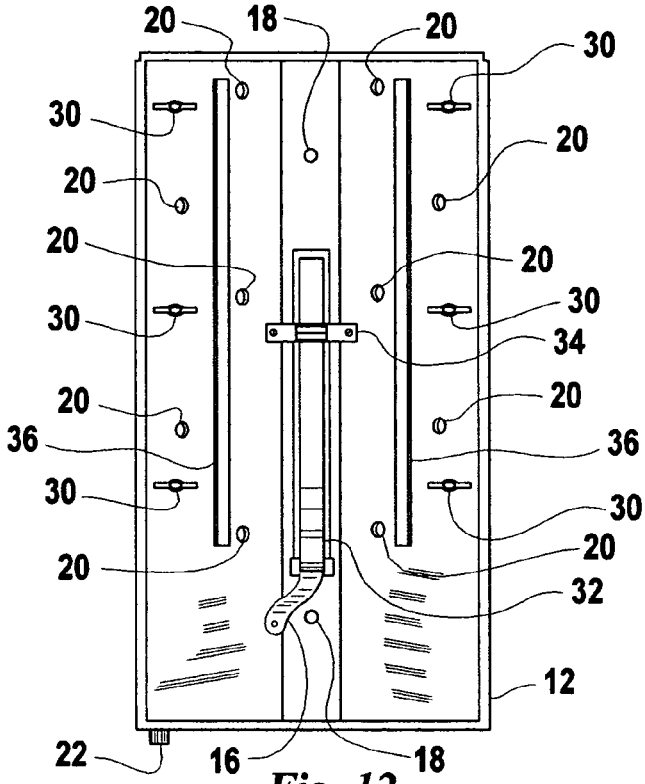
FIG. 12 shows an inside view of the container showing the toilet paper alignment bars and the track that is connected to a strap that holds upper rolls of paper in place when the door of the device is opened.

FIG. 12 shows an inside view of the container. As can be seen in this figure there are right and left toilet paper alignment bars 36 that keep the toilet rolls in position and from moving around in the container, these bars are raised to press against the toilet rolls. Mounting holes are shown as numeral 20, reinforced mounting holes 18 and there are 6 (in this example) pin compression holders 30 into which assembly pins 28 fit (shown in other figures). The hinge pin is shown at 22 and a toilet roll restraining device is shown at 32 which is held in place by a restraining bar 34. The strap track is shown at 14 and is as previously described—the strap 16 slides down and outwards when the door 6 is opened and back up into the track 14 when the door is closed. When the door is closed and a lower roll has been dispensed, gravity will make the next roll to be used to drop down to make it available for use. When the door 6 is open, as stated above, the strap 16 is in an extended position at the upper portion of where the roll to be dispensed was and below the next roll to be dispensed and therefore holds this roll, the one to be dispensed next, secure in it's position.

Figure 13:
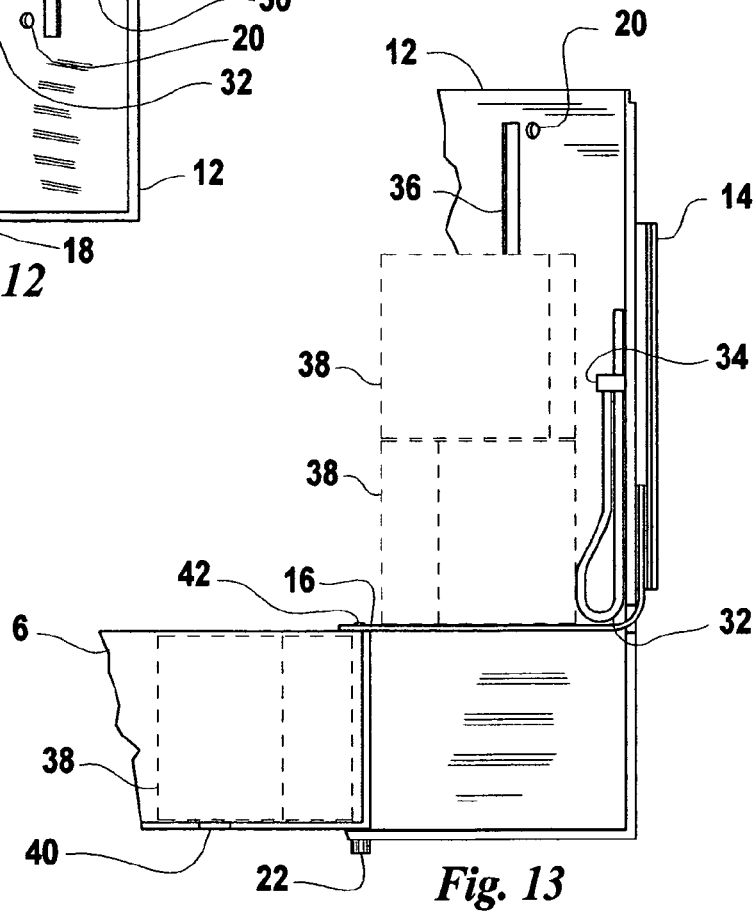
FIG. 13 shows a side view of the inside of container

FIG. 13 shows a side view of the inside of the container. Toilet rolls are shown referenced at 38. The container 12 has mounting holes 20 which enable the container to be screwed or otherwise affixed to the wall. The toilet roll alignment bar 36 runs behind the toilet rolls 38. The door 6 is shown in an open position and shows a toilet roll 38 behind it in position. This figure clearly shows the hinge pin 22 and finger slot 40 in which a user inserts his/her finger to pull a toilet roll out manually. The strap retaining pin 42 is attached to the strap 16. Numeral 32 shows a toilet roll restraining device having at its upper end a restraining bar 34.

Figure 14:
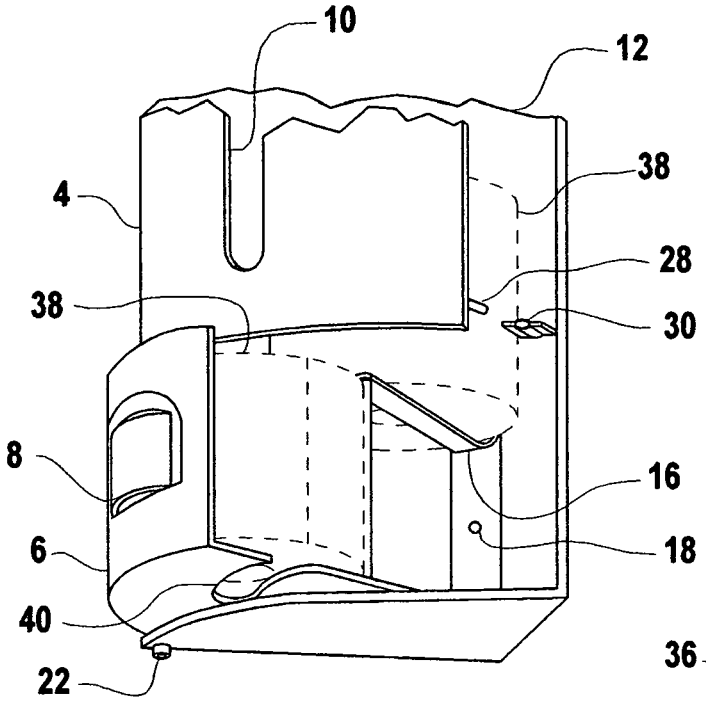
FIG. 14 shows an angled/oblique view of interior of the container with the door in an opened position and the bottom of toilet paper roll viewing aperture.

FIG. 14 shows an expanded view of the lower part of the container 12. The door 6 is shown open, the finger access slot 8 is shown allowing the opening of the door, numeral 40 shows a finger slot in which a user inserts his/her finger to pull a toilet roll out manually and the door hinge pin is shown at 22. Numeral 18 shows one of the reinforced mounting holes and the strap is shown at 16. The removable face plate 4 has the viewing aperture 10 which allows a user to see how many rolls are present in the device. Toilet rolls are shown in hashed lines at 38. The removable face plate 4 is attached via pins 28 to pin compression holders 30.

Figure 15:
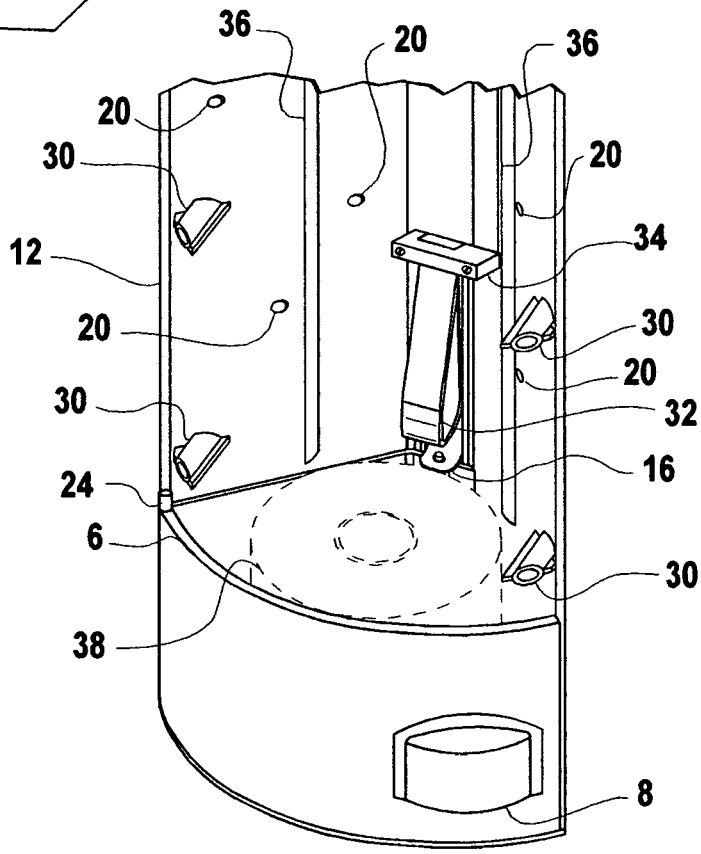
FIG. 15 shows an inside view of the container with the door closed.

FIG. 15 shows the inside of the container 12 with the door 6 shut. As previously stated toilet paper roll 38 is shown in hashed lines and the finger access slot at 8. Numeral 20 shows the container mounting holes and the pin compression holders are shown at 30. This figure clearly shows the toilet paper roll alignment bars 36, the toilet roll restraining device 32, the restraining bar 34 and the strap 16.

Figure 16:
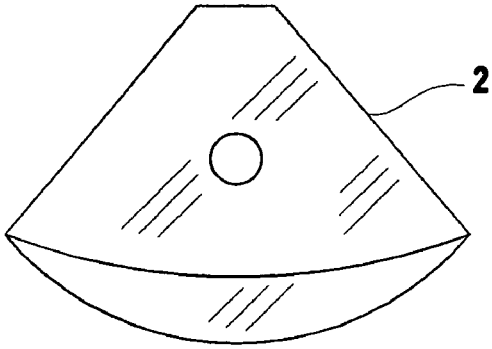
FIG. 16 shows a top view of the lid of the container.
Figure 17:
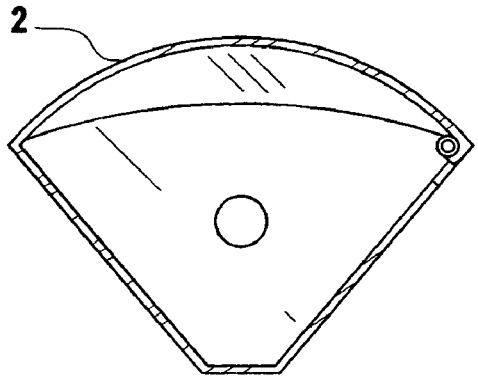
FIG. 17 shows a view of the inside of the lid of the container.
Figure 18:
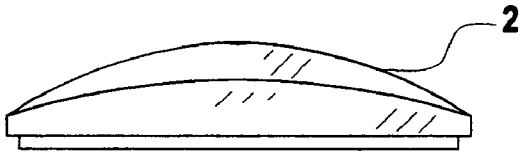
FIG. 18 shows a back view of the lid of the container.
Figure 19:
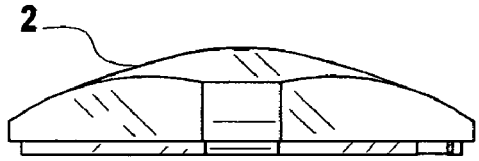
FIG. 19 shows a front view of the lid of the container.
Figure 20:
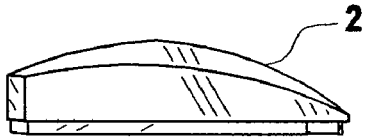
FIG. 20 shows a right hand view of the lid of the container.
Figure 21:
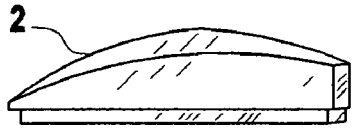
FIG. 21 shows a left hand view of the lid of the container.

Different views of the lid are shown in FIGS. 16 to 21. FIG. 16 shows the topside of the lid, FIG. 17 shows the underside of the lid (on the right hand side of this figure is shown the hole to accept the hinge pin 24 shown in FIGS. 8 and 9 for example), FIG. 18 shows a back view of the lid, FIG. 19 shows a front view of the lid, FIG. 20 shows a right hand view of the lid and FIG. 21 a left hand view. FIG. 20 shows a small "cut-out" on the bottom lip (not referenced) just under numeral 2 in the front which allows for the top to rotate without interfering with a pin when the top is rotated. This same cut-out is shown in FIG. 17 and FIG. 19.

Figure 22:
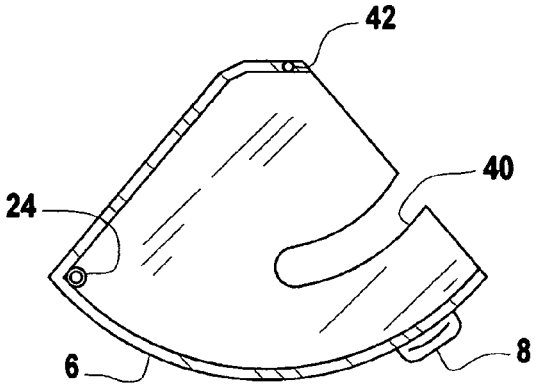
FIG. 22 shows a top left view of the bottom of the door showing the finger access slot.
Figure 23:
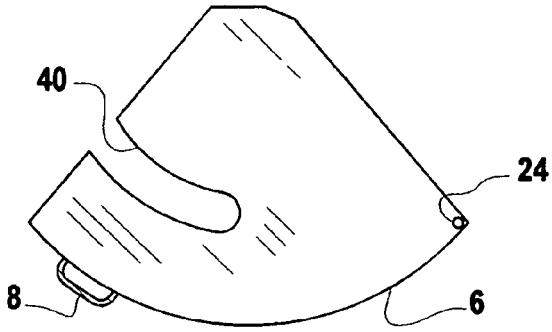
FIG. 23 shows a top right view of the bottom of the door showing the finger access slot.

FIG. 22 shows a top view of the access door 6 and FIG. 23 a bottom view of the door. Clearly seen in these figures are the finger access slot 8, hinge pin 24 and a strap retaining pin 42. Also shown is a finger slot 40 in which a user inserts his/her finger to pull a toilet roll out.

Figure 24:
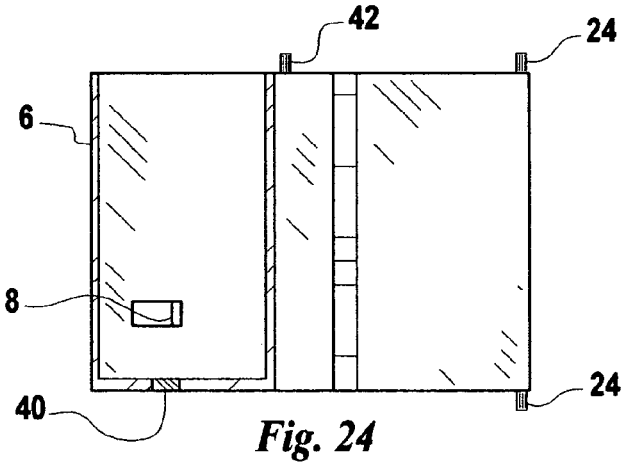
FIG. 24 shows a back view of the door at the lower end of the container.
Figure 25:
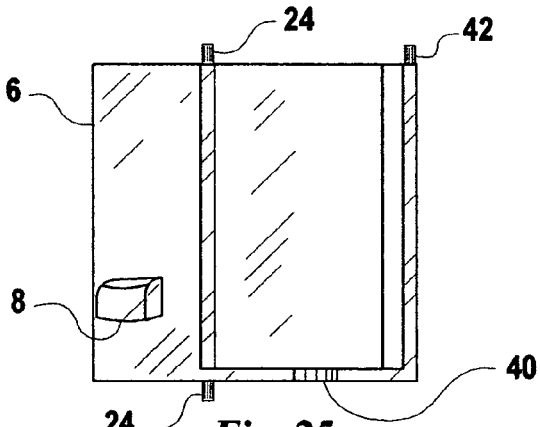
FIG. 25 shows a right hand view of the door at the lower end of the container.
Figure 26:
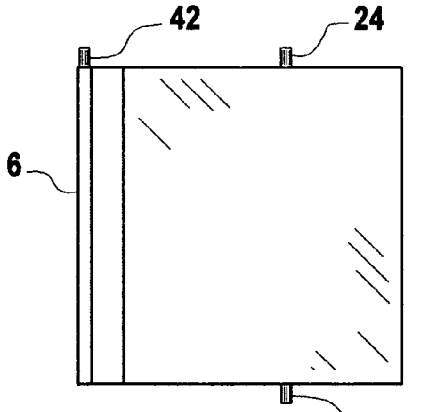
FIG. 26 shows a left hand view of the door at the lower end of the container.

FIGS. 24 and 25 show back and right hand views of the door 6 and FIG. 26 shows a left hand view of the door 6. As with other figures hinge pins are shown at 24, strap retaining pins at 42, finger access slot 8 and the finger slot 40 in which a user inserts his/her finger to pull a toilet roll out.

While only the preferred embodiment has been described above, as will be apparent to those familiar with the art, certain changes and modifications can be made in the preferred embodiment without departing from the scope of the invention as described in the following claims.

I claim:

1. A toilet paper roll dispenser comprising: a container having an upper portion and a lower portion for containing a stack of toilet paper rolls; an opening in the lower portion through which the lowermost toilet paper roll in the stack is extracted; an access door pivotally connected to the container to move between a closed position to close the opening and an open position to expose the opening and extract the lowermost toilet paper roll of the stack; an extendable strap connected at one end to the access door; a track mechanism slidably connecting the other end of the extendable strap to the container such that when the access door is moved from the closed position to the open position the strap slides in the track mechanism to an extended position so as to be positioned to support the toilet paper roll above the lowermost toilet paper roll thereby holding the stack in place while the access door extracts the lowermost toilet paper roll and when the access door is moved from the open position to the closed position the extendable strap slides into the track mechanism to a retracted position so that the next toilet paper roll drops by gravity onto the base of the access door into position to be extracted by movement of the access door from the closed position to the open position.

2. A toilet paper dispensing container as claimed in claim 1 wherein the access door has a lower surface to support the lowermost toilet paper roll of the stack and having a finger slot in which a user inserts a finger to pull a toilet paper roll from the lower surface.

3. A toilet paper dispensing container as claimed in claim 1 wherein a pivoted lid is provided on the upper end portion of the container to allow filling of the container.

4. A toilet paper dispensing container as claimed in claim 1 wherein the access door has a finger access slot into which a finger is inserted to allow the access door to be moved between the closed position and the open position.

5. A toilet paper dispensing container as claimed in claim 1 wherein the container has a viewing aperture allowing a user to view how many toilet paper rolls are contained in the container.

6. A toilet paper dispensing container as claimed in claim 1 wherein mounting holes are provided on the rear of the container to allow the mounting of the container on a surface.

7. A toilet paper dispensing container as claimed in claim 1 wherein reinforced mounting holes are provided on the rear of the container to allow secure mounting of the container to a surface.

8. A toilet paper dispensing container as claimed in claim 1 wherein the front of the container comprises a slidable removeable faceplate.

9. A toilet paper dispensing container as claimed in claim 1 wherein toilet paper roll alignment bars are provided on the inside of the container to hold the toilet paper rolls therein in place.

10. A toilet paper dispensing container as claimed in claim 1 wherein the container includes walls angled so that the container can be mounted in a corner where two walls meet.

* * * * *